United States Patent [19]

Yoshinaga et al.

[11] Patent Number: 4,502,465

[45] Date of Patent: Mar. 5, 1985

[54] CATALYST COMBUSTION CURLING DEVICE

[75] Inventors: Sadao Yoshinaga, Ichikawa; Yoshinobu Tajiri, Ohsaka; Hiroyoshi Mashine, Soka, all of Japan

[73] Assignees: Prince Industrial Development Co., Ltd., Tokyo; Koizumi Sangyo Co., Ltd., Ohsaka, both of Japan

[21] Appl. No.: 515,871

[22] Filed: Jul. 21, 1983

[30] Foreign Application Priority Data

Jul. 22, 1982 [JP] Japan ..... 57-128133
Jun. 15, 1983 [JP] Japan ..... 58-91550[U]
Jul. 11, 1983 [JP] Japan ..... 58-107395[U]

[51] Int. Cl.[3] ..... A45D 1/04

[52] U.S. Cl. ..... 126/409; 431/255; 431/256; 431/328; 431/344; 132/33 R; 132/37 R

[58] Field of Search ..... 126/409, 408; 219/222, 219/225; 132/33 R, 37 R; 431/12, 153, 255, 256, 275, 328, 344, DIG. 1

[56] References Cited

U.S. PATENT DOCUMENTS

| | | | |
|---|---|---|---|
| 4,177,646 | 12/1979 | Guadagnin et al. | 431/130 X |
| 4,243,017 | 1/1981 | Diederich | 126/409 |
| 4,248,208 | 2/1981 | Diederich | 126/409 |
| 4,374,528 | 2/1983 | Tittert | 132/37 R |
| 4,382,448 | 5/1983 | Tittert | 132/33 R |

*Primary Examiner*—Randall L. Green
*Attorney, Agent, or Firm*—Weingarten, Schurgin, Gagnebin & Hayes

[57] ABSTRACT

A catalyst combustion curling device comprises a handle interiorly provided with a liquefied gas tank; a heating barrel mounted on the handle to serve as a curling iron member or a member for mounting the teeth of a comb; a combustion valve provided on the liquefied gas tank; a catalytic member for combusting a liquefied gas from the combustion valve within the heating barrel; and an ignition device for the liquefied gas and an operator on the side of the handle to open and close the combustion valve.

18 Claims, 15 Drawing Figures

CATALYST COMBUSTION CURLING DEVICE

BACKGROUND OF THE INVENTION

In a hair curling device in which a liquefied gas tank is provided interiorly of a handle, the liquefied gas is combusted by a catalyst within a barrel-like curling iron member connected to the associated handle to heat the interior of the curling iron member and a tress of hair held on the side of the curing iron member is curled into the desired shape, it is necessary to heat the catalyst. This heating of catalyst is performed by temporarily combusting the liquefied gas using electric heat.

In the conventional construction, an electric heater for temporarily igniting and combusting a liquefied gas is incorporated into a tip of a curling iron member which comprises a heating barrel. In use, an operating member on the side of a handle is first moved to open a combustion valve and next a switch of the heater is depressed to energize a coil of nichrome wire to ignite and combust the liquefied gas flow to a portion of the catalyst. After the catalyst has been heated by said combustion, the coil is deenergized and the combustion is switched to be made by the catalyst. Also in the prior arts developed as disclosed in U.S. Pat. Nos. 4,243,017 and 4,248,208, the ignition operation is achieved at the tip of the curling iron member.

These proposals have disadvantages that the opening and closing operation of the combustion valve and the ignition operation of the electric heater need be performed separately from each other, and that the electric heater has to be incorporated into the tip of the curling iron member, which forms the disadvantage in terms of construction.

Also, in the catalyst combustion curling device in which the teeth of a comb are provided on the circumference of the heating barrel, mounting of the teeth is accomplished by use of a cylindrical inserting member, and in many cases, the teeth are formed of synthetic resin such as nylon and molded integral with said inserting member having a number of holes.

If the cylindrical inserting member is used to mount the teeth of a comb on the circumference of the heating barrel, there poses disadvantages that since the number and size of the holes bored in the heating barrel are limited, the heat efficiency is poor and that heat is confined within the heating barrel whereby internal temperature increases more than as needed and when the device is used for a long period of time, the inserting member is softened due to heating, bringing forth deformation when subjected to external force, resulting in irregularities of teeth arrangement.

Furthermore, in the curling device of this kind, a liquefied gas emitted from a nozzle member is ignited, a catalytic member is heated by combustion heat at that time, a fire valve is then closed once to extinguish flame, the fire valve is again opened to permit the liquefied gas to flow to the catalystic member, and combustion is carried out in a non-flame condition to heat the interior of the heating barrel to a temperature suitable for curling.

As the disadvantage encountered in the catalyst combustion as described above, since the combustion occurs in the non-flame condition, it is difficult for the user to see the presence of flame and insure if the combustion is being made. In view of this, in proposals in which combustion can be insured by a position of an ignition operating lever or in which a battery is used for an ignition device, the combustion can be insured by the ignition of a small pilot lamp.

However, where a voltage device or a flint used in a gas lighter is used as an ignition device, a pilot lamp cannot be provided, and the combustion is not reliable only by the position of the ignition operating lever. Many users try to insure the combustion by the operation of the lever. Therefore, combustion does not occur unless the fire valve closed to discontinue combustion and the ignition operating lever is returned to its initial position after which the lever is operated, and therefore the products have been often erroneously judged to be defective.

Moreover, in the conventional construction, a catalytic member is press fit into a retaining member formed into a coil, the retaining member is press fit into a heating barrel and the catalytic member is fixed upwardly of a fire nozzle. As an alternative form, a retaining member in which a net is formed into a cylindrical shape is used and a catalytic member is press into and secured to a heating cylinder. In any of these proposals, however, the retaining has to be manufactured lengthy, and therefore, there poses a problem in that the weight of the heating cylinder becomes increased which involves a difficulty in use..In addition, there is another disadvantage that since the retaining member having a resiliency is forcibly pushed into the heating cylinder, the fixed position of the catalytic member is liable to produce a difference, and despite one and the same construction, different combustion sometimes occurs.

SUMMARY OF THE INVENTION

This invention has been achieved in an attempt of eliminating these disadvantages noted above with respect to conventional catalyst combustion curling devices to make it possible for users to use the device more convienently and safely.

The improvement over the conventional liquid gas ignition means as described above has been realized by employment of a piezo-electric device generally commercially available as a source of ignition of a gas lighter. It became possible to continuously perform combustion by a catalyst from temporary combustion of liquefied gas, by operation of a single member.

This piezo-electric device is provided within a handle together with a liquefied gas tank, and the liquefied gas, which is ignited for combustion by a discharge spark generated between a nozzle member of a combustion valve provided on the liquefied gas tank and a discharge electrode of the piezo-electric device, heats a catalytic member upwardly of the nozzle member.

The catalytic member is provided within a heating barrel by a retaining member in the form of a metal wire connected to a cap member at the extreme end of the heating barrel, and is fixed by both a receiving member projected internally of the heating barrel and the retaining member in order that a spacing between the catalystic member and said nozzle member is made more accurate.

The retaining member has a lower end in which a metal wire is made in the form of a coil, and a catalytic member in which a metal catalyst such as platinum, palladium, etc. is incorporated in the form of lattice or honey-comb is fitted into the coil-like lower end. At the lower side of the catalytic member is provided a pilot member which can see through a window of the heating barrel and can be insured from the outside. With this construction, simplification of catalytic member and readiness of mounting the same can be achieved and readiness of assurance in combustion by the red-hot pilot member can be achieved.

Furthermore, in the curling device in which the teeth of a comb for hair curling are provided on the circumference of a heating barrel, a required number of fitting grooves are provided in the external surface of the heating barrel, the fitting grooves being utilized for mounting the teeth of a comb. Said fitting grooves can be utilized as fitting grooves of a transparent glass which blocks a window of said pilot member to prevent entry of hair into the heating barrel through the window and prevent a leak-out of unburned liquefied gas.

Combustion of liquefied gas produced by a discharge spark is automatically stopped by continuous operation of the aforesaid member to extinguish flame generated by combustion, and the combustion is switched to catalytic combustion. This switching is performed by means of a lever member provided on a combustion valve, and combustion control is automatically brought forth by means of a bimetal to prevent overheat due to combustion for a long period of time.

In the present invention adapted to achieve the aforementioned objects, a piezo-electric device is provided on the side of a liquefied gas tank provided interiorly of a handle, a discharging electrode connected to the piezo-electric device is disposed on the extreme end of a nozzle member of combustion valve in which flow rate can be automatically adjusted by means of a bimetal, and an ignition lever which also serves as an opening and closing member for the combustion valve is provided over an actuating member of the piezo-electric device and a slidable operator provided on the side of the handle, whereby the ignition lever is operated by the sliding movement of the operator to open the combustion value and the piezo-electric device is actuated to generate a discharge on the extreme end of the nozzle, by which discharge the primary combustion of the liquefied gas can be carried out.

In addition to the aforementioned structure, a required number of fitting grooves are longitudinally provided in the external surface of the heating barrel, a ridge portion of a comb-tooth member formed of synthetic resin and integrally provided with a number of teeth is formed in the same sectional shape as that of the fitting grooves, said ridge portion being inserted into the fitting groove to mount the comb member on the heating barrel, and the comb member is neither deformed nor disengaged even if the comb member is formed of synthetic resin.

Moreover, fixing of the catalytic member is accomplished by a retaining member in the form of a metal wire whose lower end is formed in the form of a coil or by the retaining member and a receiving member projected within a base end of the heating barrel, and a springing force generated at the coil-like lower end is utilized to press the catalytic member against the receiving member, thereby increasing a vibration resistance and maintaining a spaced distance at constant. A red-hot pilot member is provided between the fire valve and catalytic member, and a peep-window of the pilot member is suitably provided in the lower portion of the heating barrel so that the combustion condition may be always assured from the outside.

BRIEF DESCRIPTION OF THE DRAWINGS

The drawings show embodiments of a catalyst combustion curling device in accordance with the present invention.

PREFERRED EMBODIMENTS OF THE INVENTION

Figure 2:
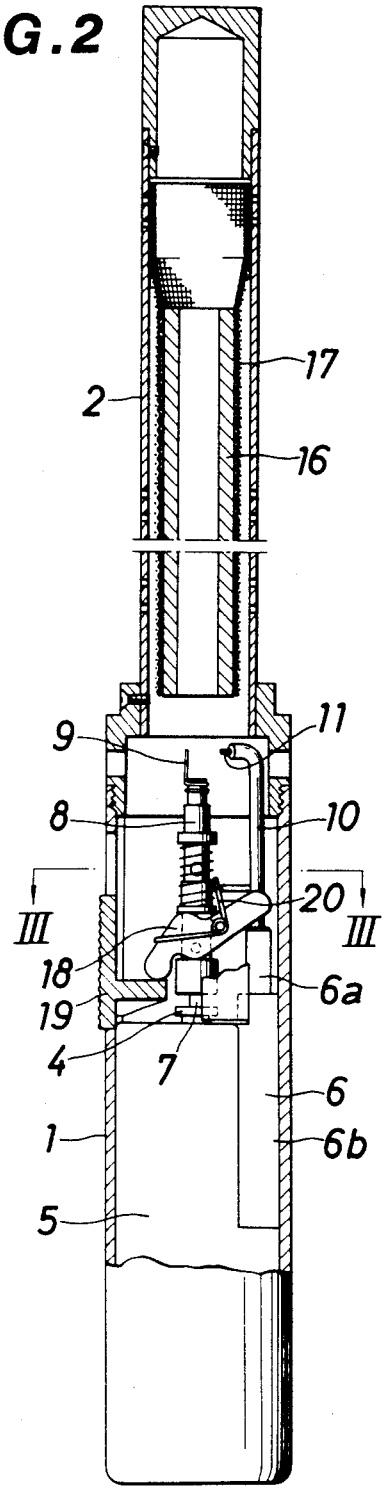
FIG. 2 is a side elevational plan view of said curling device.
Figure 1:
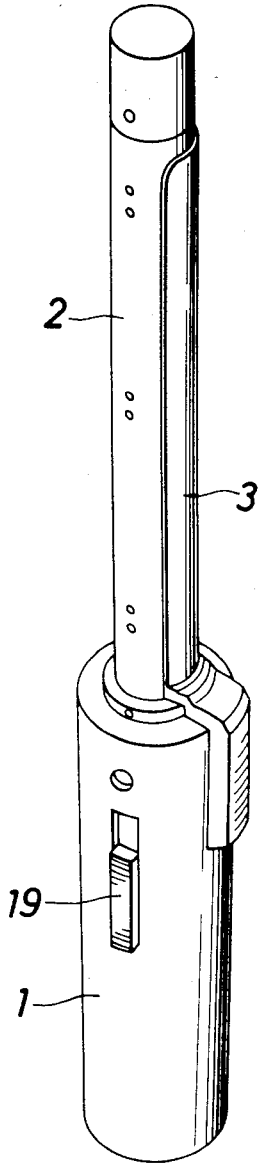
FIG. 1 is a perspective view of the curling device in which a heating barrel comprises a curling iron member.
Figure 3:
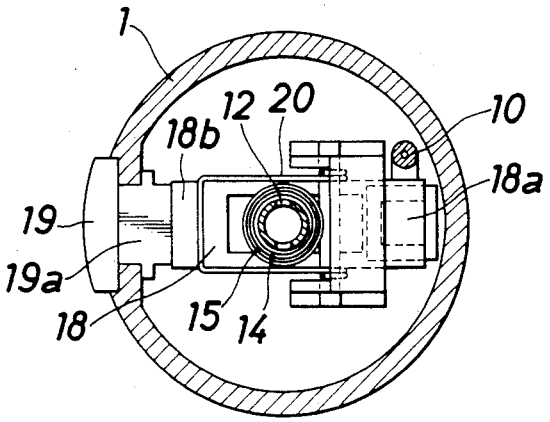
FIG. 3 is a sectional view taken along line III—III of FIG. 2.

In the following, preferred embodiments of the present invention will be described in detail with reference to the drawings.

A reference numeral 1 designates a cylindrical handle and a reference numeral 2 designates a curling iron member mounted on the handle, said curling iron member comprising a heating barrel. A reference numeral 3 designates a hair clipping plate mounted openably and closeably on and resiliently against the side of the curling iron member.

Interiorly of the handle 1 there are provided a liquefied gas tank 5 having a combustion valve 4 provided at top thereof and a piezo-electric device 6 which are disposed parallel to each other.

The piezo-electric device 6 is generally used as a source of ignition for a gas lighter and is designed so that an actuating member *6a* is disposed movably up and down at an upper portion of a case *6b* with a return spring provided, and though not shown, a piezo-electric element and a hammer on which a shock spring acts are provided within the case *6b*, whereby the hammer is moved away from the piezo-electric element against the shock spring by downward movement of the actuating member *6a* and the hammer is released from the actuating member *6a* at the position wherein the shock spring is fully compressed to shock the piezo-electric element by the hammer to generate piezo-electricity.

A valve tube 7 which is operative to open and close a valve within a valve body is provided movably up and down on the combustion valve 4 with a spring member provided to always bias said valve tube 7 in a closing direction though not shown. This valve tube 7 is electrically connected to the piezo-electric element, and a nozzle member 8 is connected to an upper end thereof. A negative (−) electrode 9 is mounted on the upper end of the nozzle member 8 and the extreme end of a lead wire 10 derived from the piezo-electric device 6 is arranged in the form of a positive (+) electrode 11 on the opposite end of the negative (−) electrode 9 so as to generate a spark discharge across a nozzle orifice.

The nozzle member 8 is bored in its side with a surplus air hole 12 and with a spaced air hole 13, and in the periphery of the nozzle member 8 is loosely fitted movably up and down a short barrel-like member 14 for opening and closing said upper surplus air hole 12 by a biasing coil spring 15 mounted between an upper flange thereon and the member 14 which biases the member 14 in position where the hole 12 is nominally exposed.

Interiorly of the curling iron member 2 is hung and fixed a cylindrical catalytic member 16 located upwardly of the nozzle member 8, by means of a support member 17 formed from a net. This catalytic member 16 is formed of asbestos and platinum or palladium to combust the liquefied gas emitted from the nozzle orifice.

A reference numeral 18 designates an ignition lever which is mounted within the handle by means of a shaft 21 and movable clockwise, said ignition lever being provided over the actuating member **6*a* of the piezo-electric device 6 and an operator 19 provided on the side of the handle. This ignition lever 18 is constructed in a way that a pair of cam plates positioned on opposite sides of the nozzle member 8 are connected at opposite ends, the aforesaid opening and closing member 14** being brought into abutment against the upper side of the cam plate.

The ignition lever 18 has an extreme end **18*a* positioned on the actuating member 6*a* whereas a rear end 18*b* thereof positioned on a projected piece 19*a* of the operator 19, and a lower side 18*c* formed on the cam is brought into abutment with a shoulder 8*a* provided at the lower portion of the nozzle member 8 and is normally biased in a closing direction by mounting of a spring member 20**.

In the above described construction, when the operator 19 is slidably moved upward, the ignition lever 18 rotates about a pivot 21 clockwise against the spring member 20. With this rotation, the lower side **18*c* is moved in a direction of moving away from the end 8 to remove the pressing force with respect to the valve tube 7 and the combustion valve 4 is opened so that the liquefied gas flows into the nozzle member 8. When the operator 19 is further lifted, the opening and closing member 14 is moved up by the cams of the ignition lever 18 against the coil spring 15 to close the surplus air hole 12. As the lever rotates, the actuating member 6*a* is downwardly pushed in and finally the hammer within the piezo-electric device is released to shock the piezo-electric element by spring pressure to generate piezo-electricity thus generating a spark discharge between the negative (−) electrode 9 and the positive (+) electrode 11**.

This discharge causes the ignition of liquefied gas flowing out of the nozzle orifice, where temporary combustion occurs to generate flame to heat the upper catalytic member 16. After maintainance of said heating condition for an extremely short period of time (4 to 6 seconds), and when the operator 19 is pulled back halfway, the opening and closing member 14 is pushed back together with the ignition lever 18 to open the surplus air hole 12, whereby the surplus air flows into the nozzle member at once to lose the balance of combustion to blow off the flame and the liquefied gas keeps flowing out.

The liquefied gas, when coming into contact with the heated upper catalytic member 16, begins its combustion by the function of the catalyst without generation of flame, and the temperature in the curling iron member increases to heat the curling iron member 2.

And, when the operator 19 is pulled in and returned to its original position, the nozzle member 8 is pushed down by the ignition lever 18 and the combustion valve 4 assumes the closed position to stop outflow of liquefied gas. The actuating member **6*a*** is then returned to its original position by means of a return spring within the piezo-electric device and the combustion ceases.

Accordingly, by the actuation of the operator 19, it is possible to effect the discharge and ignition of liquefied gas, heating of catalytic member 16 by momentary combustion of liquefied gas, blowing off of combustion flame, combustion of liquefied gas by the catalytic member 16 having a catalyst and suspension of combustion.

Figure 5:
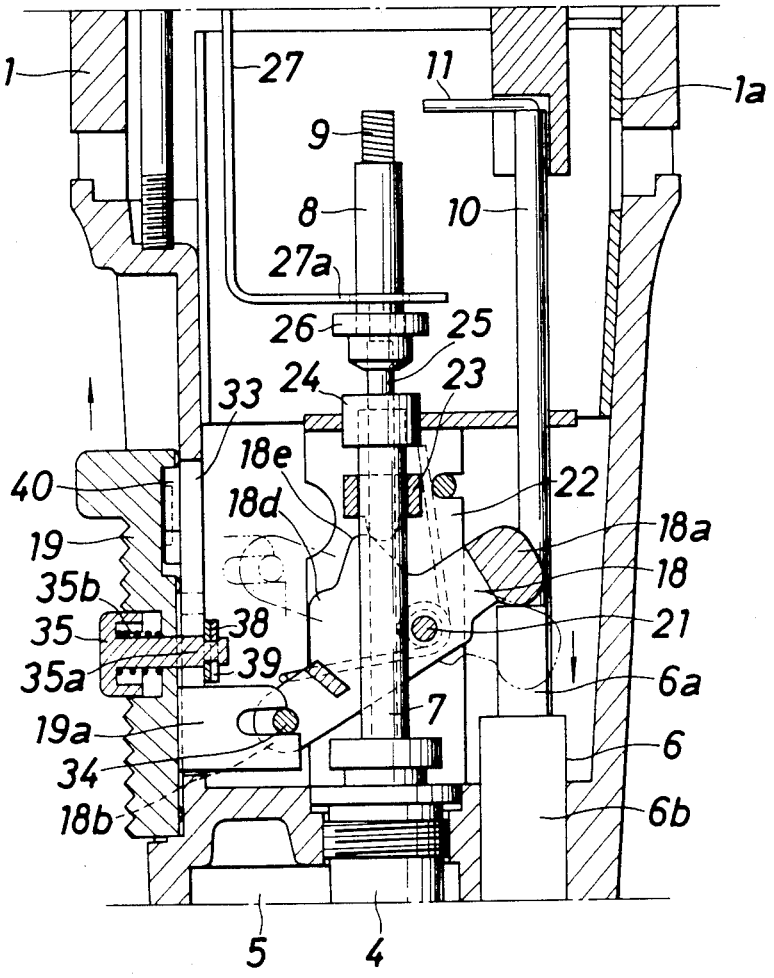
FIG. 5 is a partly side elevational plan view of the ignition device of a further embodiment.

In the embodiment shown in FIG. 5, there is shown an ignition device in which the upper end of the valve tube 7 is forced up by said ignition lever 18 to open a valve provided interiorly of the combustion valve 4 to ignite an emitting liquefied gas.

The ignition lever 18 provided rotatably about a pivot 21 on the support member 22 at the upper portion of the liquefied gas tank 5 has a cam continuously formed at the upper side with a first projection **18*d* and a second projection 18*e*. These projections 18*d* and 18*e* are different in height from each other in order that the valve tube 7** may be maintained under open and closed positions.

In the periphery of the upper end of the valve tube 7 is loosely fitted a lift member 23 provided at the lower side with a projection with a stopper means applied thereto though not shown, and a stopper 24 is secured to the valve tube 7 in the upper portion of the lift member 23. Through these elements the valve tube 7 is moved up and down by the projections **18*d* and 18*e* of the aforesaid cam. Inserted into the valve tube 7 is an inner pipe 25 which serves as a liquefied gas passageway, and the nozzle member 8 provided with the electrode 9 is connected to the extreme end of the inner pipe 25. A flange member 26 formed of a heat insulating material is mounted around the lower portion of the nozzle member 8, and a horizontal portion 27*a* of an L-shaped bimetal 27 extended from the heating barrel is disposed above and suitably spaced apart from the flange member 26**.

Figure 6:
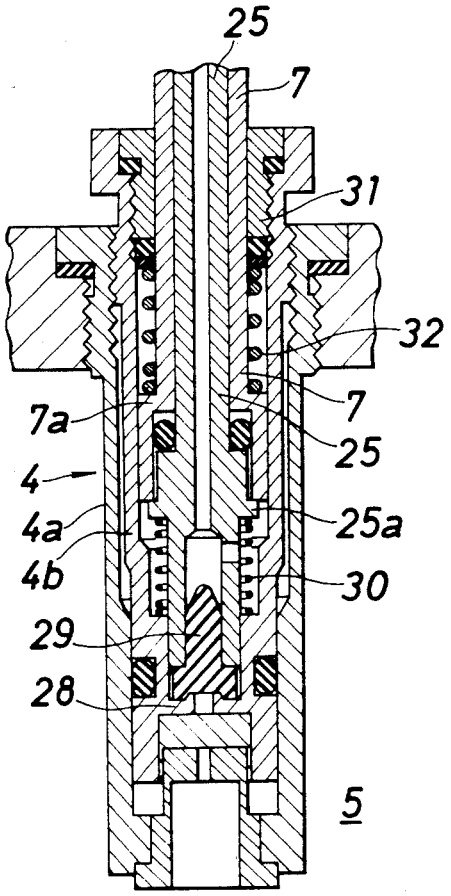
FIG. 6 is a longitudinal sectional view of a combustion valve.

As shown in FIG. 6, the combustion valve 4 has a valve body **4*b* within a valve casing 4*a* secured to an upper wall of the liquefied gas tank 5, and a lower portion of the valve tube 7 and a lower portion of the inner pipe 25 are inserted into the valve body. The lower end of the inner pipe 25 extends through the lower end of the valve tube 7 to be positioned on a valve seat 28 provided within the lower portion of the valve body 4*a*, and a valve body 29 is mounted on the lower end thereof. A flange 25*a* is formed in the periphery of the lower end of the inner pipe 25, and a coil spring 30 for biasing the inner pipe 25 in an opening direction is provided between the flange 25*a* and the valve seat 28**.

A coil spring 32 for closing a valve which is greater in strength than the aforesaid coil spring 30 is provided between the flange portion 7*a* formed at the lower end of the valve tube 7 and a cover member 31 of the valve body 4*a*, and the lower end of the valve tube is pressed against the flange 25*a* of the inner pipe 25 by means of said coil spring 32.

In the combustion valve 4 having the construction as described above, when the valve tube 7 is moved upward against the coil spring 32, the inner pipe 25 is also moved upward. This movement is effected by the coil spring 30 to open the valve. It is noted that under the condition wherein the valve tube 7 is moved upward, the inner pipe 25 can be moved downward against the coil spring 30 and the valve seat 28 can be closed by the valve body 29. These operations can be accomplished by the operator 19 of FIGS. 5 and 7 connected to the aforesaid ignition lever 18.

Figure 7:
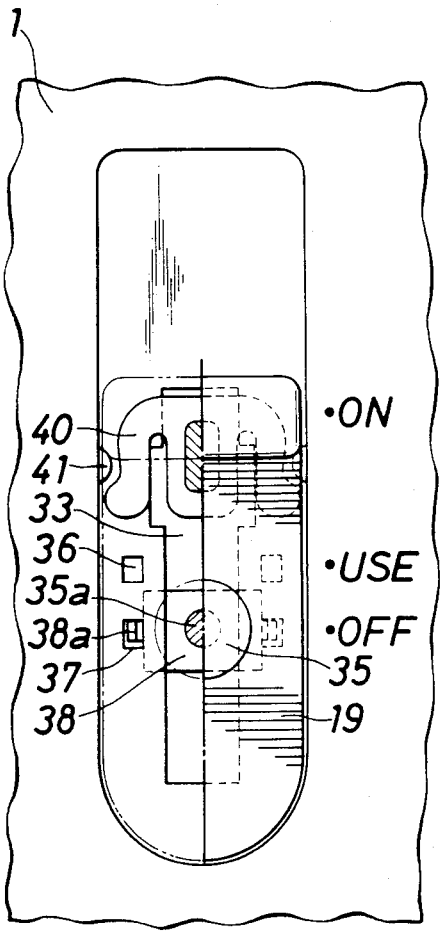
FIG. 7 is a partial view of a handle with a half of an operator cutaway.
Figure 8:
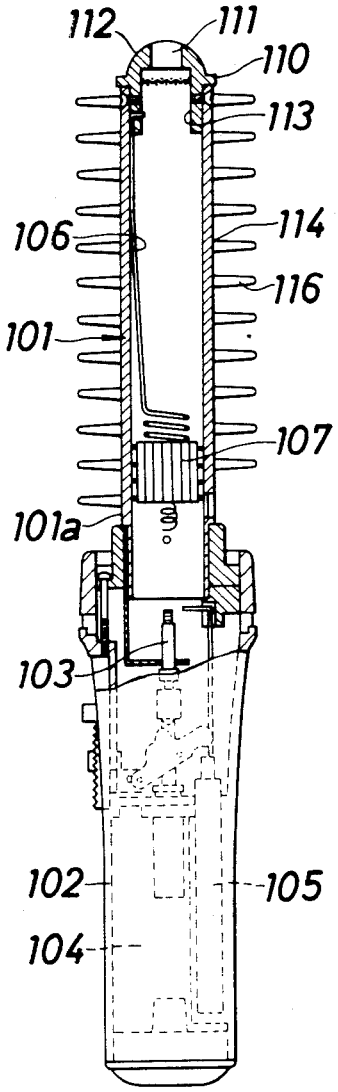
FIG. 8 is a partly side elevational plan view of a curling device having the teeth of a comb on the circumference of the heating barrel.
Figure 9:
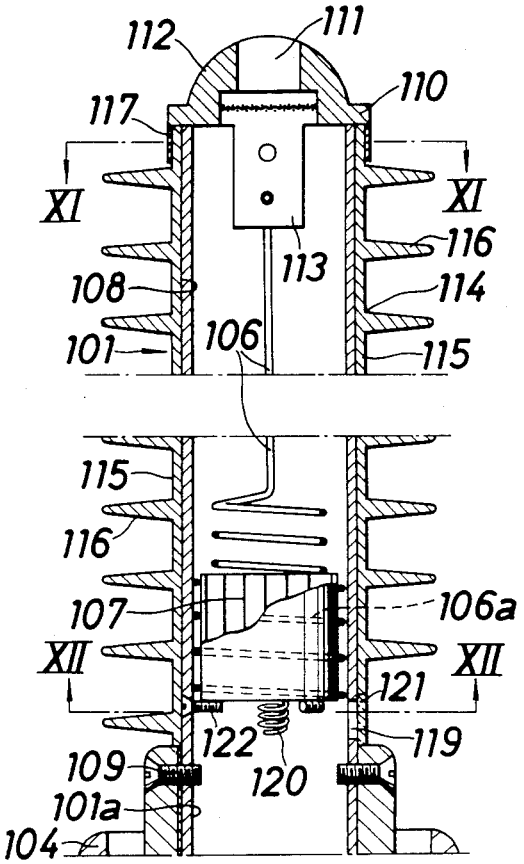
FIG. 9 is a side elevational plan view showing essential parts of said curling device.
Figure 10:
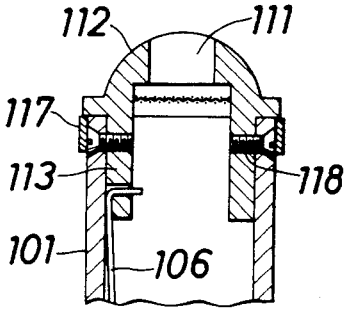
FIG. 10 is a sectional view of the extreme end of said curling device.
Figure 11:
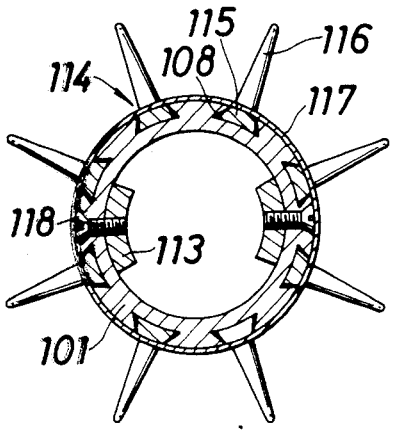
FIG. 11 is a sectional view taken along line XI—XI of FIG. 9.
Figure 12:
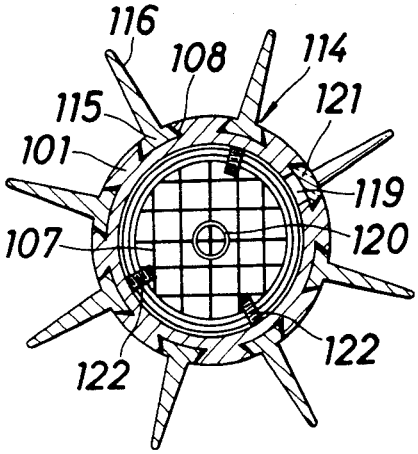
FIG. 12 is a sectional view taken along line XII—XII of FIG. 9.
Figure 13:
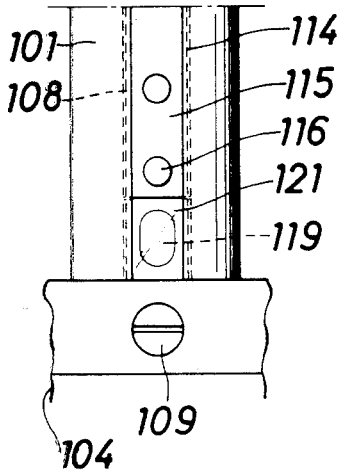
FIG. 13 is a front view of a pilot window portion.

The operator 19 moves in a longitudinal groove 33 formed in the handle 1 formed of synthetic resin, in a manner similar to the operator shown in FIGS. 1 to 4. The inside of the handle 1 is protected by a metal flame resisting plate 1*a*. Connection with the rear end 18*b* of the ignition lever 18 is accomplished by a lateral groove formed in the projection 19*a* and a pin 34. A lock button 35 provided with a foot portion 35*a* which extends through the groove 33 and has an extreme end positioned within the handle 1 is provided movably in and out of the lower portion of the operator 19 with a spring 35*b* exerting thereon. A lock plate 38 is mounted on the end of the foot portion 35*a* by means of a snap ring 39, which lock plate 38 has pawls 38*a* bended at opposite ends thereof to fit into locking holes 36 and 37 bored up and down along both sides of the groove 33 as shown in FIG. 7. The operator 19 is formed at its upper back side with a recess 19*b* into which is inserted a clip spring 40 made of synthetic resin. This clip spring 40 is provided to engage a small semi-circular projection 41 projected on the side of the handle 1 to retain the return of the operator 19 at a predetermined position.

This operator 19 can be moved upward by means of a thumb of a hand which grips the handle 1. In movement of the operator 19, the lock button 35 is pushed in with the web of the thumb engaged on the operator 19, and the pawl 38*a* of the lock plate 38 fitted in the hole 36 on the side of the handle is pushed out of the hole 36 to make the operator 19 free. Next, the operator 19 is pushed up until it stops while the lock button 35 remains pushed in.

Since the rear end 18 of the ignition lever 18 is connected to the projection 19*a* of the operator 19 by means of the pin 34, the ignition lever 18 rotates clockwise about the pivot 21, like the ignition lever shown in FIGS. 1 to 4, against the pin 42 of the support member 22 stood on the liquefied gas tank 5 and the torsion lever 20 provided on the rear end of the ignition lever. This rotation causes the cam on the upper side of the ignition lever to push up the valve tube 7 through the lift member 23 and the stopper 24 against the coil spring 32 within the valve body 4*b*. As the result, the pressing force against the inner pipe 25 is released, the inner pipe 25 is then pushed upward by the coil spring 30 and the valve body 29 is moved away from the valve seat 28 to open the valve. Simultaneously when the valve is opened, the liquefied gas flows into the passageway in the inner pipe 25 through a clearance between the valve body 4*b* and the lower end of the inner pipe and flows outside from the nozzle member 8 at the upper end of the inner pipe.

After the lapse of a short period of time after the valve has been opened, the actuating member 6*a* of the piezo-electric device 6 is pressed by the extreme end 18*a* of the ignition lever 18 to actuate the hammer within the case 6*b* to shock the piezo-electric element to generate piezo-electricity, in a way similar to that of the embodiments shown in FIGS. 1 to 4. This piezo-electricity flows into from the lead wire 10 to provide discharge between the electrode 11 and the electrode 9 of the nozzle member 8 to ignite and combust the emitting liquefied gas. Air required for combustion is taken into an air opening 43 at the upper portion of the handle 1.

After the catalytic member has been heated by said combustion, flame is extinguished for switching the mode into catalytic combustion. This extinction is automatically performed merely by releasing the thumb from the operator 19. When the pressure by the thumb is released, the operator 19 is pushed back to the original position, that is, counterclockwise together with the rear end 18*b* of the ignition lever 18 by means of the torsion spring 20 of the ignition lever 18. However, since the lock button 35 is also returned to the original position by the coil spring 35*b* at the same time the thumb is released, the pawl 38*a* of the lock plate 38 is fitted into the upper hole 37 to stop the returning of the operator 19. In the fitted position of the pawl 38*a*, the clip spring 40 and the projection 41 are fitted to generate resistance thereat whereby the operator 19 is not returned by the torsion spring 20 but stays halfway. On the side of the ignition lever 18, the lift member 23 is moved up and down along the cam surface, the valve tube 7 is moved down once together with the inner pipe 35 at a valley portion between two projections 18*d* and 18*c*, and the valve seat 28 shown in FIG. 6 is closed by the valve body 29 so that the combustion is suspended to extinguish flame. By counterclockwise rotation of the ignition lever 18, the lift member 23 comes into contact with the projection 18*d*, the lift member 28 is again pushed up and the valve tube 7 and the inner pipe 25 move up to open the valve again. At this time, the actuating member 6*a* is not actuated and therefore, ignition does not occur and only the liquefied gas flows towards the catalytic member whereby the combustion occurs in a non-flame condition by the previously heated catalytic member.

Finally, if the catalytic combustion is desired to be stopped, the thumb is brought into engagement with the operator 19 which stays halfway, the lock button 35 is pushed in, the pawl 38*a* of the lock plate 38 is disengaged from the upper hole 37 and the operator 19 is pulled down to the original position. By this operation, fitting between the clip spring 40 and projection 41 is released, the operator 19 and ignition lever 18 are returned to their original position, the combustion valve 4 is closed to stop catalytic combustion, and the actuating member 6*a* of the piezo-electric device 6 is also returned to its original position for next operation.

When the lock button 35 is returned to its original position by releasing the thumb, the pawl 38*a* of the lock plate 38 is fitted in the lower hole 36 and the operator 19 is locked to the handle 1. Thus, the combustion does not occur unless the operator 19 is not operated by the finger tip and therefore the device is very safe.

When the curling iron or the heating barrel side which will be described later is overheated during the use, the bimetal 27 is deformed whereby the inner pipe 25 is pushed down through the flange member 26 against the coil spring 30 within the valve body 4*b* to close the valve to stop outflow of liquefied gas. Because of this, catalytic combustion suspends. However, when the overheat calms down, the temperature lowers and the bimetal 27 is returned to its original position to release the pressing force, the inner pipe 25 is again moved up by the coil spring 30 to open the valve for restart of catalytic combustion. Thus, the catalytic combustion is automatically controlled to eliminate a danger resulting from the overheat.

Figure 4:
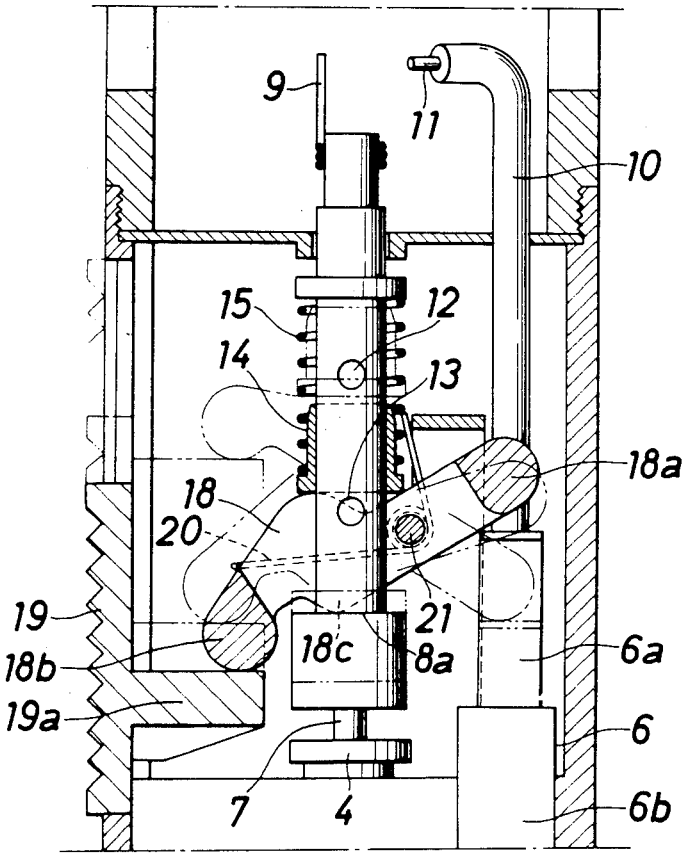
FIG. 4 is a partly side elevational plan view of an ignition device.

As described above, in the curling device of the present invention provided with the ignition device illustrated in FIGS. 4 and 5, the liquefied gas tank and piezo-electric device are provided interiorly of the handle, the discharging electrode connected with the piezo-electric device is disposed on the extreme end of the nozzle member and the liquefied gas emitted from the nozzle member can be momentarily combusted by the discharge. Therefore, it is not necessary to incorporate the electric heater into the extreme end of the curling device. With this arrangement, the curling iron member, the heating barrel and the like can be simplified in construction. In addition, the piezo-electric device is not consumed as in a battery and the electrode is not broken by heating. Therefore, the electrode need not be replaced and can be used permanently.

Furthermore, it is possible to continuously effect the outflow of liquefied gas, operation of the piezo-electric device, and heating of the catalystic combustion member by momentary combustion of the liquefied gas, by use of a single operator, and therefore, it is not necessary to separately effect heating of the catalytic combustion member and outflow operation of liquefied gas, as in the case of electric heating. Accordingly, the operation of the curling device becomes easy as compared with the conventional construction and the device can be used easily.

FIGS. 8 to 15 show the embodiment of a curling device in which a brush is provided around the heating barrel.

A reference numeral 101 designates a heating barrel and a handle 102 is mounted on a base end 101*a* thereof. The handle 102 is interiorly provided with a a liquefied gas tank 104 provided with a combustion valve having a nozzle member 103 of flow rate of gas 0.1–4 ml/sec. and a piezo-electric device 105 for ignition, said nozzle member 103 being positioned at an interval of 5 to 50 mm from a catalytic member 107 in which a metal catalyst such as platinum and palladium disposed within the base end of said heating barrel 101 by a support member 106 is incorporated into a grid, a honey-comb or the like.

The heating barrel 101 comprises a metal pipe having both ends opened and is provided on an outer surface thereof with a required number of dovetail-like fitting grooves 108 which are disposed lengthwise at regular intervals. The heating barrel 101 has a base end 101*a* formed with a shoulder, which base end is fitted into an opening of the handle 102 and fastened by means of screws 109 to be connected integral with the handle 102. Fitted in and mounted on the extreme end of the heating barrel 101 is a cap member 112 having a flange 110 which blocks the fitting groove 108 and an exhaust port 111 internally provided with a net. A foot piece 113 of the cap member 112 serves as a receiving piece for the support member 106. The above-mentioned net is provided for preventing extraneous substances from intruding into and from the exhaust port 111 and also preventing the flames that often blaze up, when the surplus gas was suddenly supplied and burnt, from blowing up through the exhaust port 111.

A reference numeral 114 designates a comb member formed of synthetic resin such as nylon which is integrally formed with a ridge portion 115 having the same sectional shape as that of the fitting groove 108 and a number of the teeth of a comb 116 disposed at regular intervals, said ridge portions 115 being inserted into the fitting grooves 108 and mounted in parallel on the outer surface of the heating barrel 101.

The comb member 114 has upper and lower ends received by the handle 102 and by the flange 110 of the cap member 112. In mounting, the comb member 114 can be merely inserted into the fitting grooves 108 from the extreme end of the heating barrel before the cap member 112 is snapped. A stop ring 117 is fitted in the outer periphery of the extreme end of the heating barrel 101 in order that the ridge portion 115 may not be disengaged from the fitting groove 108, even if the ridge portion 115 is softened due to heating, by the external force thereof.

A reference numeral 118 designates a screw for fastening the cap member 112 and a reference numeral 119 designates a window hole of a pilot 120, which hole is bored in a groove bottom on the base end of one of the fitting grooves 108. A transparent plate 121, which is held and fixed by the lower end of the ridge 115 inserted into the groove of a portion of the window hole 119 and the end of the handle 102, is inserted into said groove, the window hole 119 being blocked by the transparent plate 121.

Figure 14:
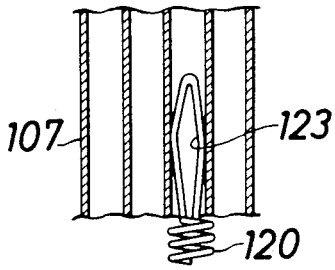
FIGS. 14 and 15 are respectively partial sectional views of a catalytic member showing a mounting example of the pilot member.
Figure 15:
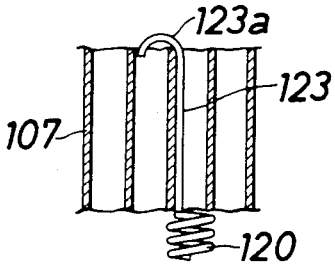

The pilot member 120 is constructed in a way that one end of a metal wire 123 is formed in the form of a coil, as shown in FIGS. 14 and 15. For one case, a linear portion of the metal wire 123 bended into two portions in a hair-pin like fashion is pushed into the catalytic member 107 to make use of resiliency of the metal wire 123 for fixation, as shown in FIG. 14. For the other case, an end of the wire located on the opposite side of the pilot member 120 in the form of a coil is formed into a hook 123*a*, the metal wire 123 is inserted and thereafter the hook 123*a* is brought into engagement with the upper side of the catalytic member 107 for fixation, as shown in FIG. 15.

On the other base end side of the fitting grooves 108, receiving members 122 are projected by means of screws into the heating barrel in three directions, and the catalytic member 107 comes into abutment with the receiving members 122.

In the above described embodiment, a required number of fitting grooves 108 are provided lengthwise on the outer surface of the heating barrel 101, the ridge portions 115 of the synthetic resin comb member 114 integrally formed with a number of the teeth of a comb 116 are formed into the same sectional shape as that of the fitting grooves 108, and the ridge portions 115 are inserted into the fitting grooves 108 to mount the comb member 114 on the heating barrel 101. With this arrangement, the comb member and the radiation surface of the heating barrel are positioned alternately, and higher heat efficiency than that of prior arts is obtained to avoid overheat even if the device is used for a long period of time. In addition, even if the ridge portion is softened to some extent, the fitting grooves and the ridge portions are hard to be disengaged since they have the same sectional shape. The arrangement of the teeth is not impaired by deformation of the ridge portions. The comb member can be merely inserted into the fitting grooves and therefore mounting requires not much trouble. The comb member can be also replaced for each fitting groove.

Furthermore, the support member 106 of the catalytic member 107 is composed of the metal wire having one end formed into a coil-like configuration and the cap member 112 is snapped over the extreme end of the heating barrel 101 whereby under the condition wherein the cap member 112 and metal wire are connected, the catalytic member 107 inserted into the coil-like end 106*a* is inserted into the heating barrel 101 together with the metal wire, and the cap member 112 is snapped over the heating barrel 101 to thereby support the catalytic member 107 within the heating barrel 101 through the metal wire. With this arrangement, the catalytic member can be inserted into the heating barrel very easily. Also, since the catalytic member can be inserted from the extreme end of the heating barrel, other parts need not be removed when such an insertion is made.

Moreover, the plurality of receiving members 122 projectingly provided within the base end of the heating barrel 101, and the the lower end of the catalytic member 107 is brought into abutment with the receiving members 122 to fix the catalytic member 107. With this arrangement, the retaining member need not be forcibly pushed in, and the position of the catalytic member is fixed by the receiving members. The catalytic member can be fixed by a suitable springing force and therefore the former is not vibrated within the heating barrel. The quantity of metal material required to form the retaining member is extremely small as compared with prior art cylindrical bodies, and the weight of the heating barrel is not increased by the presence of the retaining member.

In addition, in this embodiment, the window hole 119 of the pilot member 120 is bored in the groove bottom of the fitting groove 115 in the outer surface of the base end of the heating barrel 101, and the transparent plate 121 is snapped over the fitting grooves 115 to block the window hole 119 by the transparent plate 121. With this arrangement, entry of hair into the heating barrel is prevented during the use and flowout of unburned gas can be also prevented.

Moreover, mounting of the transparent plate is simple because the transparent plate 121 can be merely inserted into the fitting grooves, and a portion of the fitting grooves of the comb member can be utilized for the fitting grooves of the transparent plate.

Other advantages and attendant features of the present invention and many modifications hereof will readily become apparent to those with skill in the art without departing from the scope of the appended claims.

What is claimed is:

1. A catalyst combustion curling device, comprising:

a handle;

a liquefied gas tank disposed within said handle;

a heating barrel mounted on said handle to serve as one of a curling iron and a member for mounting the teeth of a comb;

a combustion valve provided on said liquefied gas tank;

a catalytic member disposed within said heating barrel for combusting liquefied gas supplied through said combustion valve;

a piezo-electric device having a first electrode disposed within said handle and to the side of said liquefied gas tank;

a nozzle member disposed in said handle and in communication with said liquefied gas tank via said combustion valve;

a second electrode disposed within said handle and in spaced relation to said nozzle member and proximate said first electrode of said piezo-electric device to generate therebetween a discharge spark for ignition of liquefied gas;

an operator accessible actuator mounted for motion with respect to said handle;

an ignition lever, coupled to said actuator, operatively connected to said combustion valve and said piezo-electric device, and mounted for rotary motion with respect to said handle in response to motion of said actuator, said ignition lever having two ends, and a cam-like portion intermediate said two ends that is rotatable for opening and closing said combustion valve, said lever having one of said ends operatively connected to said actuator for initiating rotation thereof, and having the other of said ends operatively connected to said piezo-electric device to produce said spark upon rotation of said ignition lever by means of said actuator.

2. A catalyst combustion curling device according to claim 1 wherein a required number of fitting grooves are longitudinally provided in the outer surface of said heating barrel, and ridge portions of a synthetic resin comb member integrally formed with a number of the teeth of a comb are formed into the same sectional shape as that of said fitting grooves, said ridge portions being inserted into the fitting grooves to mount the comb member on the heating barrel.

3. A catalyst combustion curling device according to claim 2 wherein said catalytic member has at a lower portion thereof a metal pilot member located between said catalytic member and the nozzle member of the combustion valve.

4. A catalyst combustion curling device according to claim 3 wherein a window hole of the pilot located between the catalytic member within the heating barrel and the nozzle member is bored in a groove bottom on the handle side of the fitting grooves provided in the outer surface of said heating barrel, and a transparent plate for blocking said window hole is snapped over said fitting grooves.

5. A catalyst combustion curling device according to claim 1 wherein said catalytic member comprises a member in which a metal catalyst formed of platinum, palladium or the like is incorporated into a grid, a honeycomb or the like.

6. A catalyst combustion curling device according to claim 1 wherein a retaining member of said catalytic member is composed of a metal wire having one end formed into a coil-like configuration and a cap member snapped over the extreme end of said heating barrel, and under the condition wherein said cap member and said metal wire are connected, the catalytic member inserted into said coil-like end is inserted into said heating barrel together with the metal wire, and the cap member is snapped over the heating barrel to thereby retain the catalytic member within the heating barrel through the metal wire.

7. A catalyst combustion curling device according to claim 6 wherein the catalytic member inserted into the coil-like end of said retaining member is placed on a plurality of receiving members projected into the base end of the heating barrel and is pressed in contact with the receiving members by means of a springing force of said coil-like lower end.

8. A catalyst combustion curling device according to claim 1 wherein said nozzle member has a flow rate of gas of 0.1 to 4 ml/sec. and is located below said catalytic member at an interval of 5 to 500 mm.

9. A catalyst combustion curling device, comprising:

a handle;

a liquefied gas tank interiorly provided within said handle;

a heating barrel mounted on said handle to serve as one of a curling iron member and a member for mounted the teeth of a comb;

a combustion valve provided on said liquefied gas tank;

a catalytic member disposed within said heating barrel for combusting liquefied gas;

a piezo-electric device have a first electrode disposed in said handle and parallel to the side of said liquefied gas tank;

a nozzle member disposed in said handle in communication with said liquefied gas tank via a valve tube having an inner tube extending therein;

a second electrode disposed within said handle in spaced relation to said nozzle member and in spaced relation from said piezo-electric device electrode to generate a discharge spark therebetween for ignition of said liquefied gas;

an operator accessible actuator mounted for motion relative to said handle;

an ignition lever operatively coupled to said piezo-electric device and said actuator, said ignition lever having a cam including two different height projections rotatably mounted within said handle;

a coupling innerposed between said cam and said valve tube to move said valve tube and inner tube in one direction in response to abutment with one of said projections of said cam and to move said valve tube and inner tube in the opposite direction in response to abutment with the other projection of said cam;

a valve body fastened to an end of the inner tube of the valve tube;

a valve seat upon which said valve body seats that is opened and closed by said valve body;

a first coil spring for biasing said valve tube and inner pipe in an opening direction; and a second coil spring for biasing the valve tube and inner pipe in a closing direction against said first coil spring.

10. A catalyst combustion curling device according to claim 9 wherein said operator accessible actuator is moved in a longitudinal groove provided in the side of the handle; a lock button provided with a foot portion which extends through said groove and whose extreme end is located within the handle, said lock button being provided so as to be moved into the lower portion of said operator by the action of a coil spring; and a lock plate mounted on the extreme end of the foot portion of said lock button and having, on both sides, pawls for fitting into locking holes bored in upper and lower stages along both the sides of said groove.

11. A catalyst combustion curling device according to claim 9 which comprises a flange member formed of a heat insulating material mounted on the nozzle member; and a temperature controlling bimetal extended from the side of the heating barrel to the nozzle member and having one end located upwardly of said flange portion at a required interval.

12. A catalyst combustion curling device according to claim 9 wherein a required number of fitting grooves are longitudinally provided in the outer surface of said heating barrel, and ridge portions of a synthetic resin comb member integrally formed with a number of the teeth of a comb are formed into the same sectional shape as that of said fitting grooves, said ridge portions being inserted into the fitting grooves to mount the comb member on the heating barrel.

13. A catalyst combustion curling device according to claim 9 wherein said catalytic member comprises a member in which a metal catalyst formed of platinum, palladium or the like is incorporated into a grid, a honey-comb or the like.

14. A catalyst combustion curling device according to claim 9 wherein a retaining member of said catalytic member is composed of a metal wire having one end formed into a coil-like configuration and a cap member snapped over the extreme end of said heating barrel, and under the condition wherein said cap member and said metal wire are connected, the catalytic member inserted into said coil-like end is inserted into said heating barrel together with the metal wire, and the cap member is snapped over the heating barrel to thereby retain the catalytic member within the heating barrel through the metal wire.

15. A catalyst combustion curling device according to claim 14 wherein the catalytic member inserted into the coil-like end of said retaining member is placed on a plurality of receiving members projected into the base end of the heating barrel and is pressed in contact with the receiving members by means of a springing force of said coil-like lower end.

16. A catalyst combustion curling device according to claim 9 wherein said catalytic member has at a lower portion thereof a metal pilot member located between said catalytic member and the nozzle member of the combustion valve.

17. A catalyst combustion curling device according to claim 16 wherein a window hole of the pilot is located between the catalytic member within the heating barrel and the nozzle member is bored in a groove bottom on the handle side of the fitting grooves provided in the outer surface of said heating barrel, and a transparent plate for blocking said window hole is snapped over said fitting grooves.

18. A catalyst combustion curling device according to claim 9 wherein said nozzle member has a flow rate of gas 0.1 to 4 ml/sec. and is located below said catalytic member at an interval of 5 to 500 mm.

* * * * *